US006315468B2

(12) United States Patent
Kishida et al.

(10) Patent No.: US 6,315,468 B2
(45) **Date of Patent: *Nov. 13, 2001**

(54) INK JET RECORDING APPARATUS WITH A PLATEN GAP REGULATOR

(75) Inventors: Takeo Kishida; Kiyoto Komuro; Nobuhito Takahashi, all of Nagano-ken (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/173,744

(22) Filed: Oct. 16, 1998

Related U.S. Application Data

(63) Continuation-in-part of application No. 09/016,263, filed on Jan. 30, 1998, now abandoned.

(30) Foreign Application Priority Data

Jan. 30, 1997 (JP) ..... 9-31115
Oct. 17, 1997 (JP) ..... 9-285475

(51) Int. Cl.[7] ..... B41J 25/308
(52) U.S. Cl. ..... 400/55; 400/59; 347/8; 347/19
(58) Field of Search ..... 400/55, 59; 347/22, 347/29, 23, 30, 33, 8, 19

(56) References Cited

U.S. PATENT DOCUMENTS 4,420,269 * 12/1983 Ackermann et al. ..... 400/59
5,055,861 * 10/1991 Murayama et al. ..... 347/29
5,156,466 10/1992 Inagaki et al. .
5,270,738 * 12/1993 Takahashi et al. ..... 347/24
5,363,132 * 11/1994 Ikkatai ..... 347/29
5,412,411 * 5/1995 Anderson ..... 347/29
5,541,626 * 7/1996 Hiramatsu et al. ..... 400/55
6,022,091 * 2/2000 Uchikata et al. ..... 347/8

FOREIGN PATENT DOCUMENTS 0-450-748 A1 10/1991 (EP) ..... B41J/25/304
0-556-066 A2 8/1993 (EP) ..... B41J/25/304
2-300-155 A 10/1996 (GB) ..... B41J/25/304
62-242544 * 10/1987 (JP) .
4-142966 * 5/1992 (JP) .

OTHER PUBLICATIONS

Patent Abstracts of Japan, vol. 012, No. 302 (M–732), Aug. 17, 1998. JP 63–078783 A, (Silver Seiko Ltd.) Apr. 8, 1998.

* cited by examiner

*Primary Examiner*—Daniel J. Colilla
(74) *Attorney, Agent, or Firm*—Sughrue, Mion, Zinn, Macpeak & Seas, PLLC

(57) ABSTRACT

A platen-gap regulation apparatus for regulating a carriage with respect to a platen of a printer, comprises: a pair of guide members rotatably mounted on the printer via an eccentric portion, for running the carriage; and regulating means for imparting the same rotational displacement quantity to both the guide members, wherein the carriage is separated from and drawn near to a printing reference plane in parallel thereto.

14 Claims, 12 Drawing Sheets

PRIOR ART

INK JET RECORDING APPARATUS WITH A PLATEN GAP REGULATOR

This application is a continuation-in-part of application Ser. No. 09/016,263, filed on Jan. 30, 1998, now abandoned.

BACKGROUND OF THE INVENTION

The present invention relates to an ink jet recording apparatus having recording heads which move in the direction of width of recording paper, and discharges ink droplets onto recording paper in accordance with print data for printing images, and more specifically relates to the ink jet recording apparatus capable of controlling a platen-gap to an optimum position for the cleaning operation and also relates to a head cleaning control method in the ink jet recording apparatus.

Since the graphic process has become to be executed relatively easily owing to the development of personal computers, a recording apparatus is now required, which is capable of outputting in high quality, e.g., hard copies of color images displayed on a display screen.

In order to meet such a need, the recording apparatus mounting ink jet recording heads is provided. This ink jet recording apparatus is used for various printing including color printing because in a print mode the noise is relatively small and also small dots can be produced in high density.

This type of ink jet recording apparatus has ink jet recording heads for receiving ink supply from an ink storage means and a paper-feed means for transferring recording paper relative to the recording heads. While the recording heads are moved according to a print signal, ink droplets are ejected onto recording paper to form dots so that the printing operation is executed.

Due to dealing with ink of liquid, a process is executed to forcibly absorb and discharge ink from the recording heads in order to prevent clogging caused by filling ink into the recording heads or volatilization of ink solvent. Further, with providing a drive signal irrelevant to print data, ink droplets are discharged from nozzle openings of the heads.

The forcible ink discharge process for solving the ink head blocking problem is generally called the cleaning operation. When resuming the printing operation after a long halt or when the user presses down a cleaning switch to solve clogging of the ink heads, the recording heads are sealed with a capping means to apply a negative pressure for discharging ink droplets. Then, the wiping operation by a blade member comprised of elastic plates such as rubber is followed.

The operation to discharge ink droplets by applying the drive signal to the recording heads is generally called the flushing operation. The flushing operation recovers uneven meniscus near the nozzle openings of the heads by wiping and the like during the cleaning operation and is executed by a certain cycle in order to prevent clogging of the nozzle opening which discharges only few ink droplets during the printing operation.

On the other hand, in case that the printing operation is performed by the recording heads onto recording paper, a platen-gap regulating means is provided for regulating a space between a platen (paper guide plate) and the recording heads in proportion to the thickness of recording paper, so that the most suitable space between the recording heads and the surface of recording paper can be maintained. In this platen-gap regulating means, the space between the recording heads and the platen is adjusted by slightly moving in the vertical direction on the carriage side, whereon the recording heads are generally mounted.

A typical convention platen-gap regulating apparatus for regulating a gap between a platen and a recording head in proportion to the thickness of a recording medium is, as shown in FIG. 12, adapted to change the distance from a platen face or a printing reference position to a recording head h by rotating a guide member g1 situated closer to the recording head h out of a pair of guide members g1, g2 for guiding a carriage c by the displacement quantity of an eccentric shaft.

Since the recording head h in a conventional printer is turned by an angle $\Delta\theta$ equivalent to a gap regulating quantity $\delta$ centering on the other guide member g2 before and after the gap is adjusted, the parallelism between the recording medium s and the recording head h is spoiled by the angle $\Delta\theta$; this results in inconvenience in that the printing position is displaced to that degree in the direction of a line or otherwise an image is deformed lengthwise in the direction of the line. In the case of a printer for forming color images in particular, the trouble is that the tone and the like are affected by the aforementioned displacement or deformation.

As described above, during the recording head cleaning operation, processes such as discharging ink droplets by sealing the recording heads with a capping means, wiping ink layers adhered on a head nozzle plate with a cleaning member made of elastic plates, e.g., rubber are performed. However, said recording heads are moved in the vertical direction by a platen-gap regulating means in proportion to the thickness of recording paper. The position of the recording heads are not fixed.

Therefore, when the recording heads are sealed by the capping means, adherence between the heads and the cap is likely to be unstable. Consequently, technical problems occur, such as insufficient function of discharging ink droplets from the heads or increased load on a carriage.

Also other technical problems occur, for example, poor quality of wiping on the surface of the head nozzle plate as a result of a change in an extent of a contact (interference amount) between the heads and the cleaning member, or taint by indiscreetly scattering ink which is wiped by the repelling operation of the cleaning member.

SUMMARY OF INVENTION

This invention was made in view of these circumstances.

An object of the present invention made in view of the foregoing problems is to provide a novel platen-gap regulating apparatus which is free from causing an image to be badly affected before and after the gap is adjusted.

Another object of the present invention is to provide a novel platen-gap regulating apparatus capable of automatically moving a recording head to an optimum position of a recording medium and in parallel to the recording medium.

Yet another object of this invention is to provide a recording apparatus and a head cleaning control method which can secure the excellent cleaning operation by controlling relative positions between the heads and the capping means and the heads and the cleaning member during the head cleaning operation.

In order to accomplish the objects above, there is provided a platen-gap regulating apparatus according to the present invention, for regulating a carriage with respect to a platen of a printer, the platen-gap regulating apparatus comprising: a pair of guide members rotatably mounted on the printer via an eccentric portion, for running the carriage; and regulating means for imparting the same rotational displacement quantity to both the guide members, wherein the carriage is separated from and drawn near to a printing reference plane in parallel thereto.

Furthermore, in the platen-gap regulating apparatus described above, the regulating means regulates both the guide members forwardly and reversely by the same quantity in the same direction in response to the forward and reverse rolling of paper-feed driving means, and the regulating means engages with or detaches from both the guide members in response to moving the carriage.

According to another aspect of the present invention, there is provided an ink jet recording apparatus according to the present invention comprising: ink jet recording heads for discharging ink droplets correspondent with print data; a capping means for sealing said recording heads and for receiving negative pressures from a suction pump: a cleaning member for wiping the nozzle opening surface of said recording heads; a platen-gap for regulating means capable of adjusting a space between the recording heads and a printing medium in proportion to the thickness of the printing medium, whereon said recording heads print; and a control means for driving said platen-gap regulating means to hold a fixed relative position between the recording heads and said capping means and/or the recording heads and said cleaning member when said recording heads are located in a cleaning position.

In this case, in a preferred embodiment of the present invention, said platen-gap regulating means rotatably mounts a pair of guide members on the printer via an eccentric portion, for moving a carriage having the recording heads back-and-forth. Said control means provides rotation power to said guide members interlocked with the movement of the carriage.

A head cleaning control method in an ink jet recording apparatus according to the present invention made in order to accomplish the objects above comprising: ink jet recording heads for discharging ink droplets correspondent with print data; a capping means for sealing said recording heads and receiving negative pressures from a suction pump; and a cleaning member for wiping the nozzle opening surface of said recording heads. Gap judging step for judging the state of the platen-gap upon receiving a cleaning instruction of said recording heads, gap controlling step for controlling the platen-gap to be the predetermined gap when a gap is judged not to be the predetermined one in said gap judging step, and cleaning step for cleaning said recording heads with said cleaning member when said gap controlling step is over, are executed.

In this case, in the preferred embodiment of the present invention, said gap judging step judges as to whether or not the platen-gap is in the minimum state. When the platen-gap is judged not being in the minimum state, the platen-gap is controlled to be in the minimum state in gap controlling step.

According to the above-mentioned ink jet recording apparatus and the head cleaning control method, the state of the platen-gap is judged upon receiving a cleaning instruction of the recording heads. When the platen gap is not fitted to the head cleaning operation, the platen-gap regulating means is driven by the control means.

Consequently, during the recording head cleaning operation, the ink suction operation by negative pressures and also the appropriate wiping operation by the cleaning member are secured.

DETAILED DESCRIPTION OF PREFERRED EMBODIMENTS

An ink jet recording apparatus according to the present invention will subsequently be described with reference to an embodiment as shown in drawings.

Figure 1:
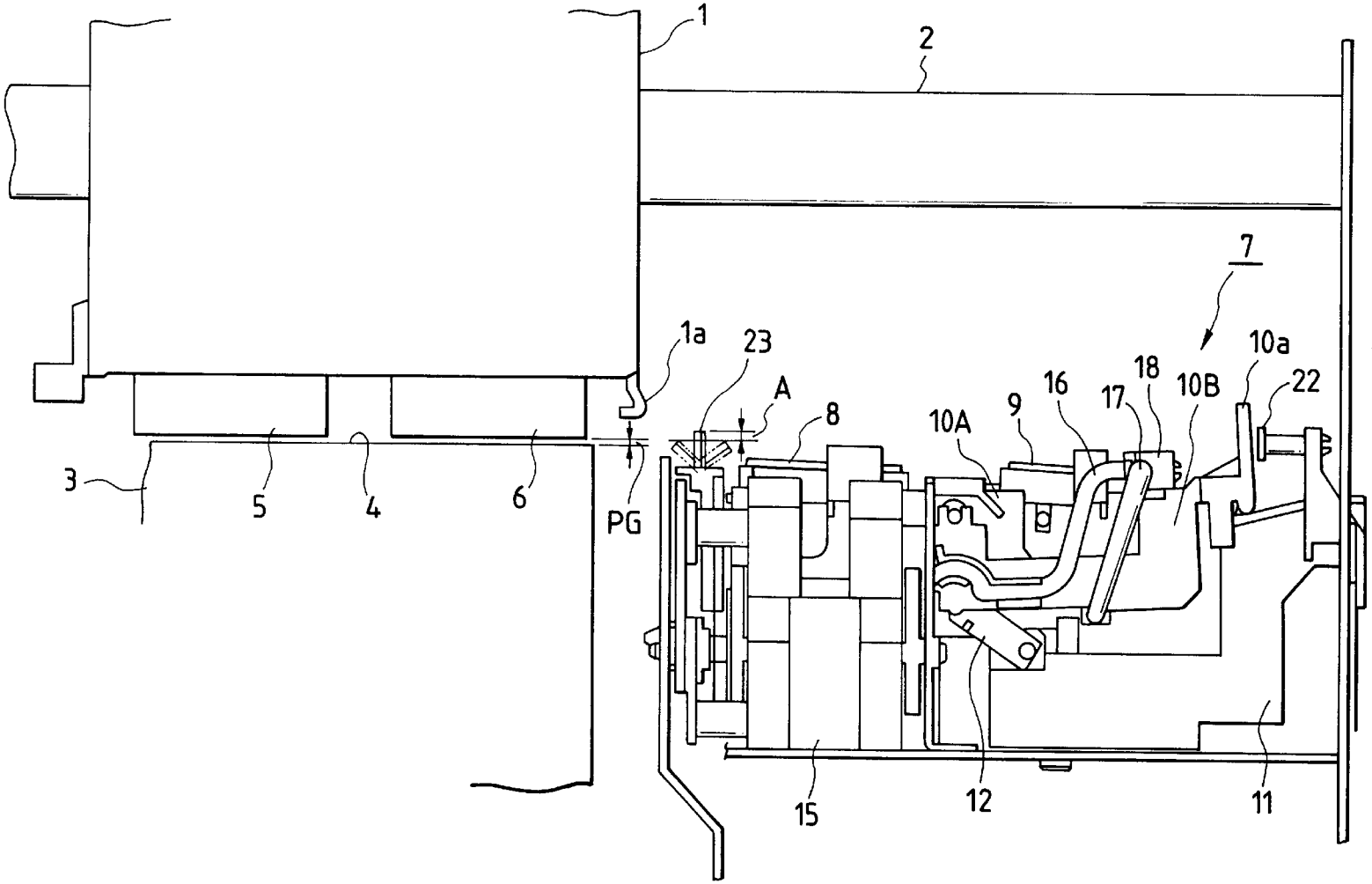
FIG. 1 is a front view showing construction of a capping means in a ink jet recording apparatus according to the present invention.
Figure 2:
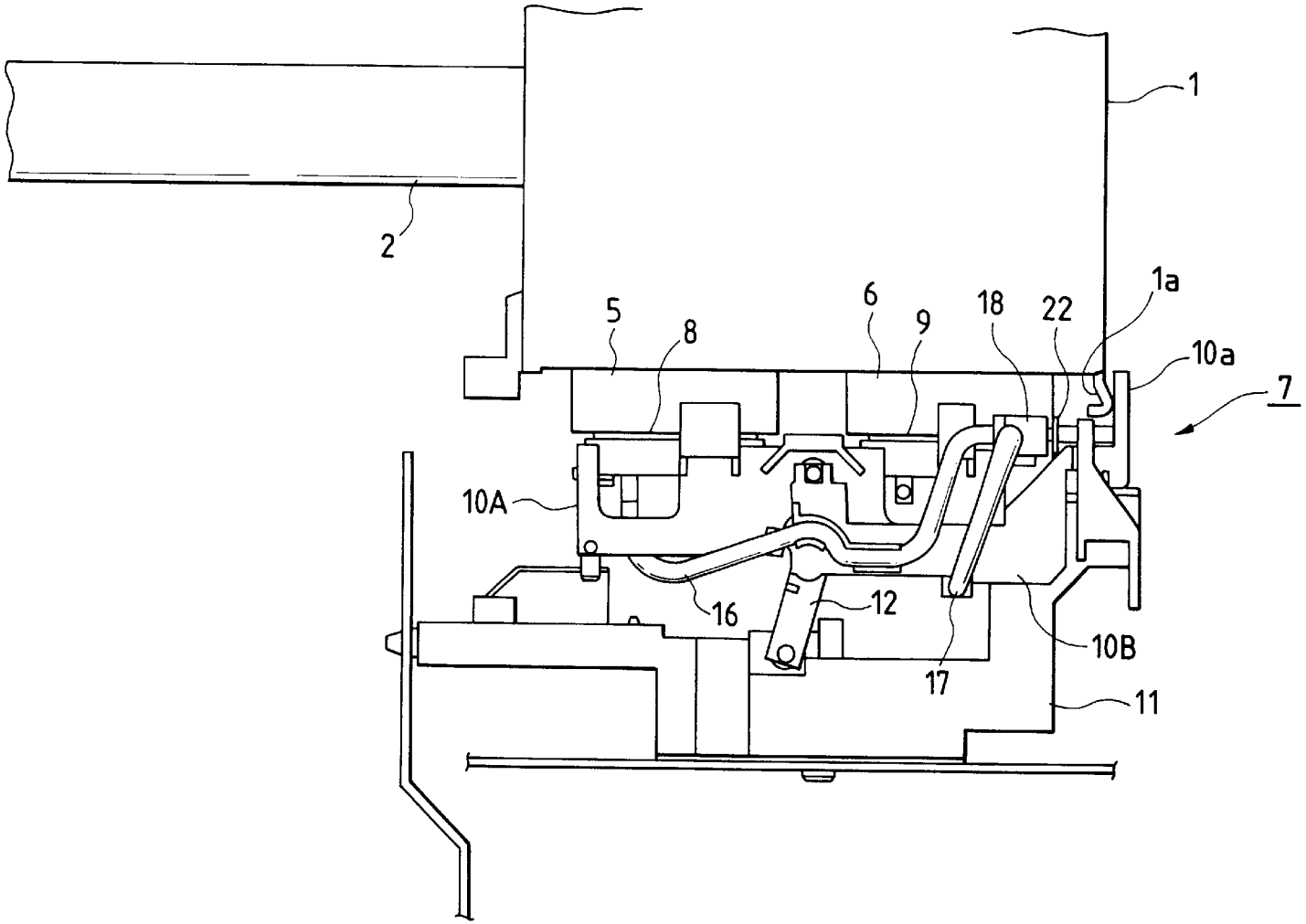
FIG. 2 is a front view showing in a capped state of recording heads by the capping means as shown in FIG. 1.

FIG. 1 shows the state of performing the head cleaning operation in the ink jet recording apparatus according to the present invention. FIG. 2 shows the state wherein ink is forcibly discharged from the heads by a capping means. Reference numeral 1 denotes a carriage. The carriage is constructed to move in parallel against a platen (paper guide plate) 3 guided by a guide rod 2. The carriage 1 is combined with a part of timing belt (not shown) and moves back-and-forth along with the guide rod 2 driven by the timing belt.

Two recording heads 5 and 6 are mounted on the carriage 1 such that the recording heads face recording paper 4 as a recording medium arranged on the upper surface of the platen 3. Ink is introduced to the recording heads 5 and 6 respectively and ink droplets are discharged on said recording paper 4 on the platen 3 according to print data and the printing operation is executed.

A capping apparatus 7 as the capping means is disposed in the non-print section of the recording apparatus. A capping member 8 for capping one recording head 5 and a capping member 9 for capping the other recording head 6 are mounted on an upper slider 10A.

The upper slider 10A is fixed on a lower slider 10B arranged to be able to raise with an arcuate track against frame 11 via a lever 12, so that the head can swing. The cap members 8 and 9 are constructed to be able to contact with the recording heads 5 and 6 in parallel respectively from the bottom.

As shown is FIG. 2 when the carriage moves to the right above the capping apparatus 7, a projection 1*a* arranged on the carriage 1 contacts with a protrusion 10*a* fixed to a part of the lower slider 10B, so that the lower slider 10B is raised via the lever 12 and capping members 8 and 9 seal the recording heads 5 and 6 respectively disposed on the carriage.

Figure 3:
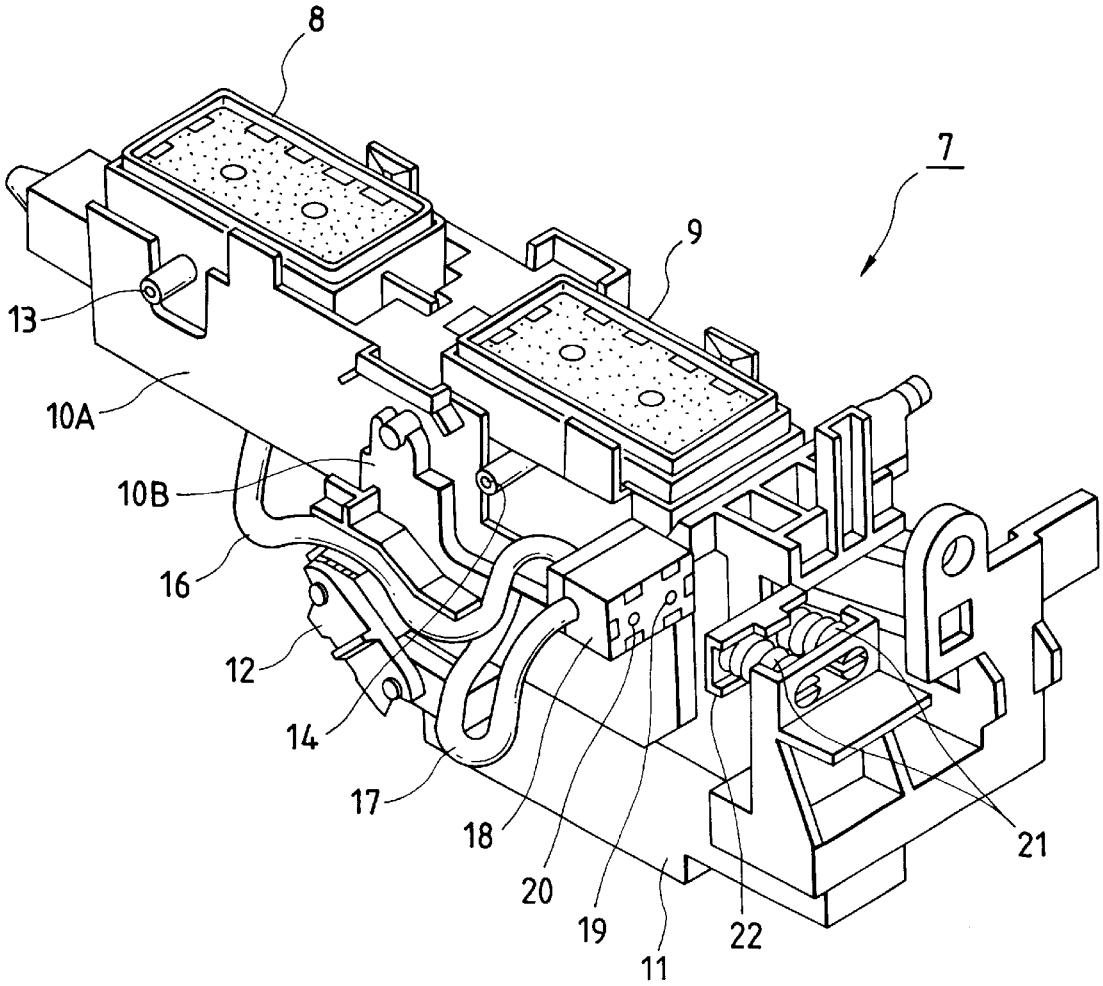
FIG. 3 is a perspective view showing further detailed construction of the capping means as shown in FIG. 1 and FIG. 2.

As shown precisely in FIG. 3, the capping members 8 and 9 disposed on said capping apparatus 7 are made in a size so to seal the nozzle opening surface of the recording heads 5 and 6 respectively in one space. The inner space surrounded by each capping member 8 and 9 connects with ink suction ports 13 and 14. Tubes to be described later are connected to the suction ports 13 and 14 and seal nozzle opening of the recording heads 5 and 6 in a non-print mode. Further, in case of receiving a cleaning instruction, a proper negative pressure is applied respectively by a pump unit 15, so that ink can forcibly discharged from the recording heads 5 and 6.

One end of the tubes 16 and 17 are connected to the bottom part of the capping members 8 and 9, and the other end of each tube 16 and 17 communicates with air opening ports 19 and 20 of a valve member 18.

When the capping members 8 and 9 move to a position where the recording heads 5 and 6 can be capped, in the section where the valve member is located, a valve body 22 elastically connected to the valve member 18 is disposed while always being urged to the side of the valve member 18 by a spring 21. Air opening valves comprise the tubes 16, 17, the valve member 18, the air opening ports 19, 20, the spring 21 and the valve body 22 so as to communicate with the capping members 8 and 9, respectively.

As shown in FIG. 1, on the side of print section adjacent to the capping apparatus 7, for example, a rubbery cleaning member 23 is set for wiping the nozzle opening surface of said recording heads 5 and 6 mounted on the carriage 1 interlocked with the movement of the carriage.

In the recording heads 5 and 6, dust and paper powder adhered to a nozzle plate are removed with this cleaning member 23 before ink suction. Thus, adhesion of the capping members 8 and 9 is improved. Furthermore, ink adhered to the nozzle plate is wiped out after suction.

Figure 4:
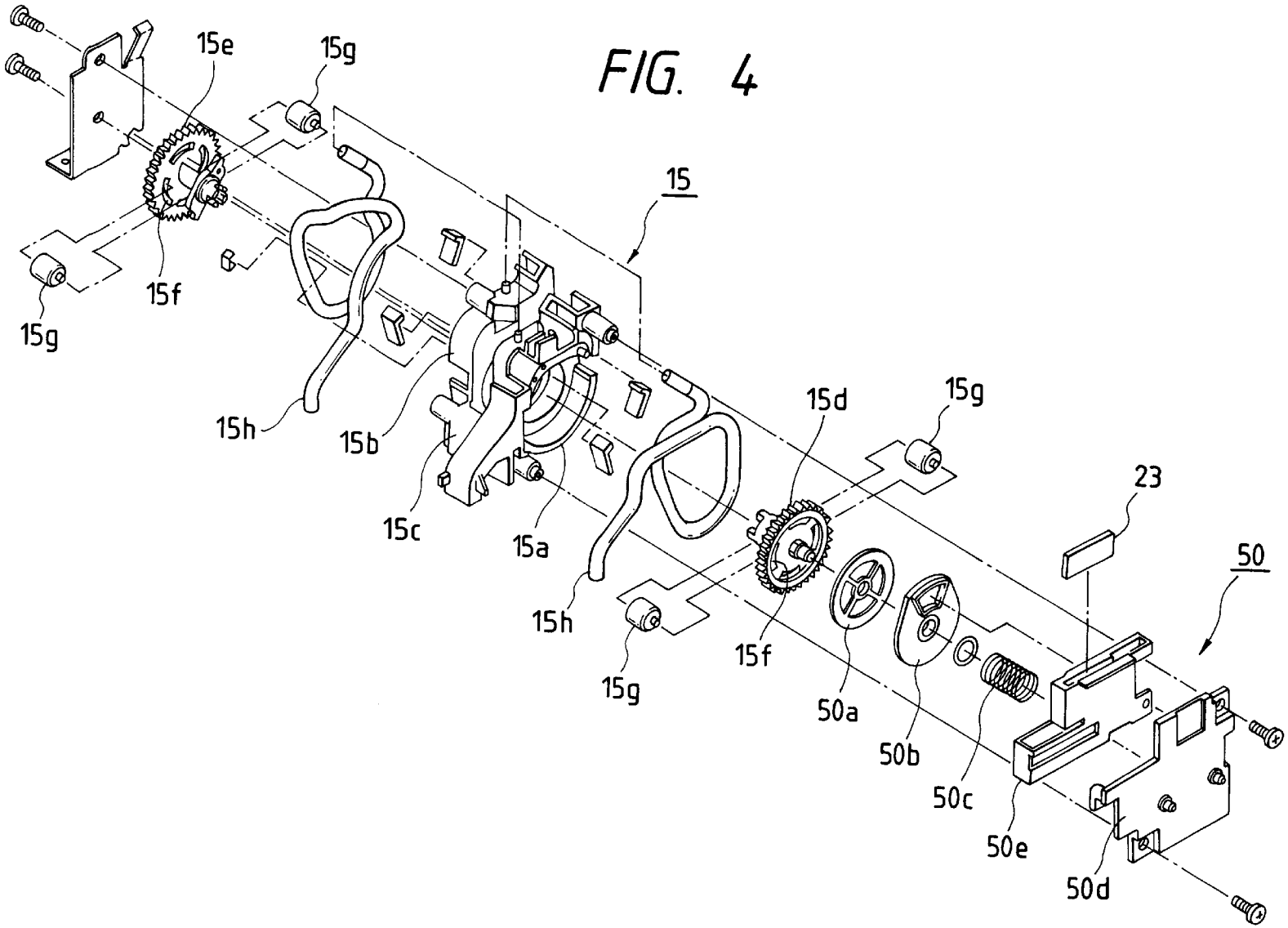
FIG. 4 is an exploded perspective view showing construction of a pump unit and a cleaner driving unit contained in the recording apparatus as shown in FIG. 1.

This cleaning member 23 is formed in such a way that a cleaner driving unit makes it possible for the cleaning member 23 to trespass or take shelter on and from the wiping position on the moving course of the recording heads 5 and 6. FIG. 4 is an exploded perspective view showing construction of a pump unit 15 containing a cleaner driving unit 50.

First, the pump unit 15 contains a pump frame 15*c* having cylindrical portions 15*a* and 15*b* at both the respective ends. These cylindrical portions 15*a* and 15*b* are arranged so that each pump wheel 15*d* and 15*c* rotate forward and reverse direction after receiving driving force of a paper feeding motor (not shown and called ASF motor hereafter).

Two shaft holes 15*f*, one end of which extends to the center and the other end extends to outer circle are provided respectively in each pump wheel 15*d* and 15*e*. As a result, in response to the rolling direction of the pump wheels 15*d* and 15*e*, a roller 15*g* supported pivotally by these shaft holes 15*f* is arranged capable of being biased against the center or the side of outer circle. The pumping operation for applying a pressure to a tube 15*h* between the cylindrical portions 15*a* and 15*b* by the roller 15*g* and the release operation without applying a pressure to the tube 15*h* are carried out.

One end of said tube 15*h* is connected to the ink suction ports 13 and 14 of said capping apparatus 7. When a cleaning instruction is received, a negative pressure by driving the pump unit 15 is applied to inner space surrounded by the capping members 8 and 9.

In the cleaner driving unit 50, a cleaner cam is fixed with play via a clutch plate 50*a* to a pivot of the pump wheel 15*d*. The cleaner cam 50*b* is formed to be pressed and connected to the clutch plate 50*a* by a compression spring 50*c*.

A slide lever 50*e*, whereon a cleaning member 23 is fixed, is fitted to a frame 50*d* being slidable in horizontal direction and said cleaner cam 50*b* is engaged with a part of this slide lever 50*e*.

Said cleaner cam 50*b* is dragged to the same direction via clutch plate 50*a* in accordance with one way rotation of the pump wheel 15*d* and cause said slide lever 50*e* to move in the horizontal direction on one side. Further, the cleaner cam 50*b* is dragged to the other direction via clutch plate 50*a* in accordance with the other way rotation of the pump wheel 15*d* and cause said slide lever 50*e* to move in the horizontal direction on the other side.

Therefore, said cleaning member 23 installed on the top of the slide lever 50*e* operates to trespass on or to take shelter from the wiping position on the moving course of the recording heads 5 and 6 in response to the forward and reverse rolling of the ASF motor for driving the pump unit 15. Thus, when the cleaning member 23 is trespassing on the wiping position of the print heads 5 and 6, the nozzle surface of the print heads 5 and 6 are wiped out.

Figure 5:
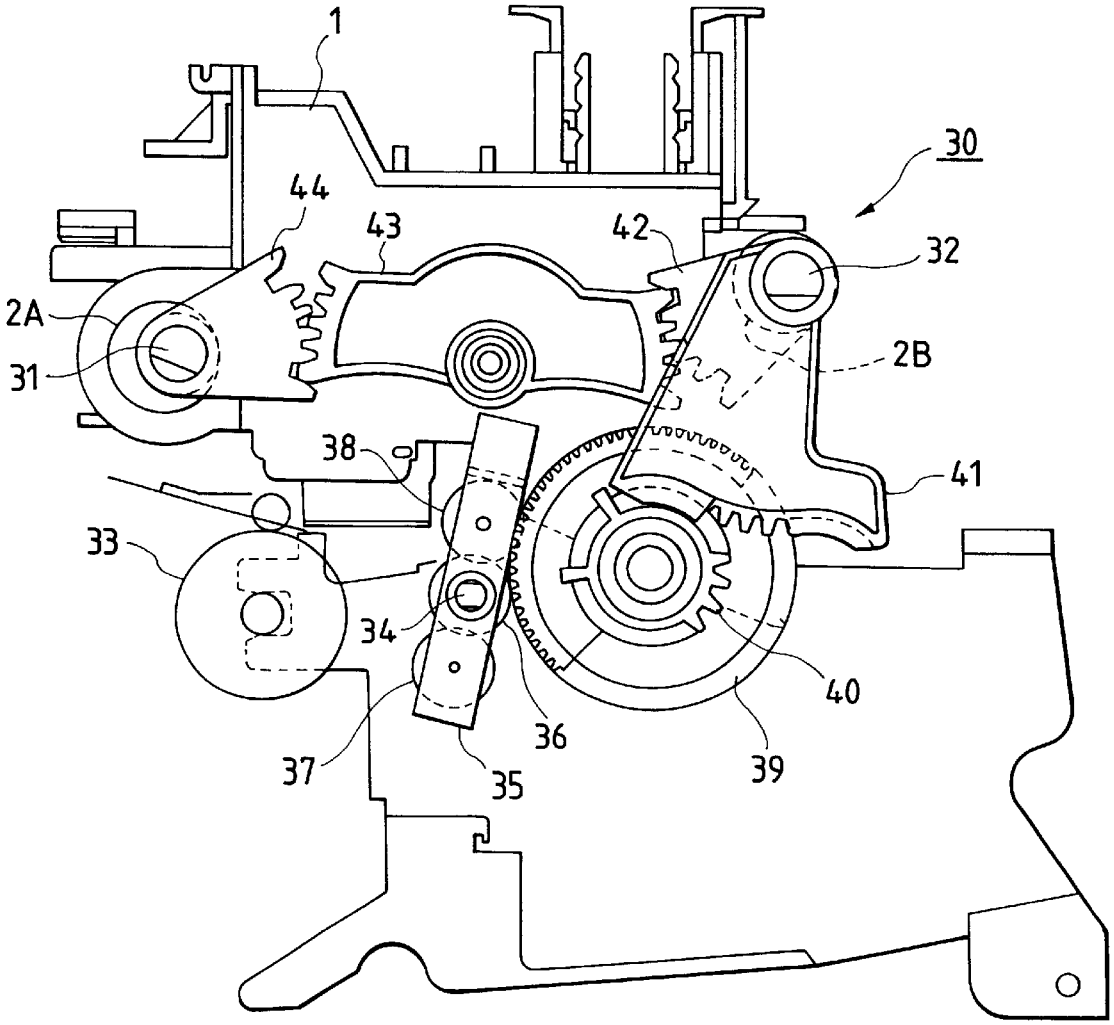
FIG. 5 is a side view showing an embodiment of a platen-gap regulating means adapted to the ink jet recording apparatus.
Figure 6:
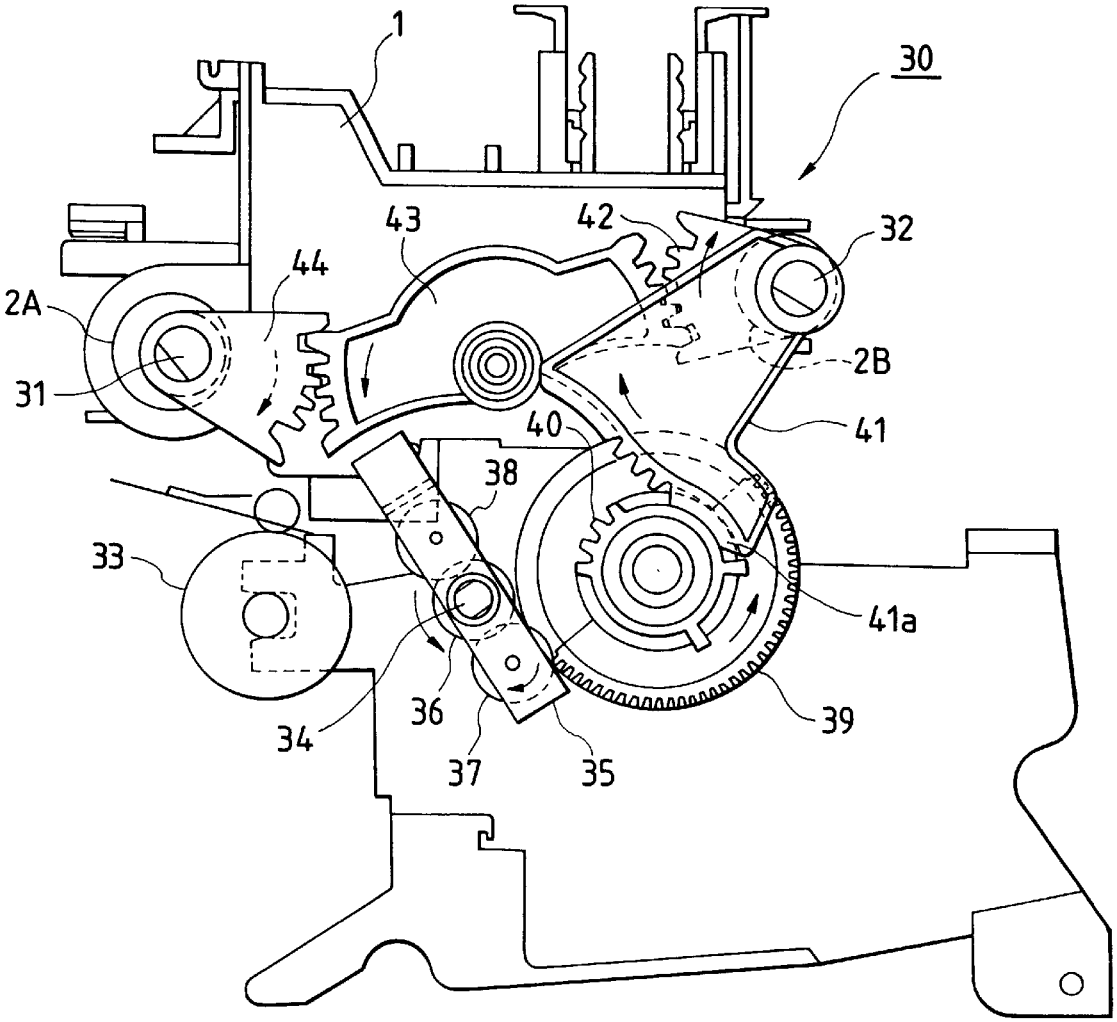
FIG. 6 is a side view of the platen-gap regulating means above when an adjustment is made to enlarge the gap.

Next, FIGS. 5 and 6 show the construction of a platen-gap regulating means 30. The guide rod 2 for guiding said carriage 1 consists of two rods 2A and 2B. These rods 2A and 2B are rotatably mounted on a guide frame (not shown) via eccentric pins 31 and 32 which are biased in the same direction and fixed at both ends. When the gap regulating system to be described later, operates to rotate the guide rods in the same direction, the carriage 1 supported by the guide rods 2A and 2B is separated from or drawn near to the platen 3 in parallel. In this case, reference numeral 33 denotes a paper feed roller.

Figure 11:
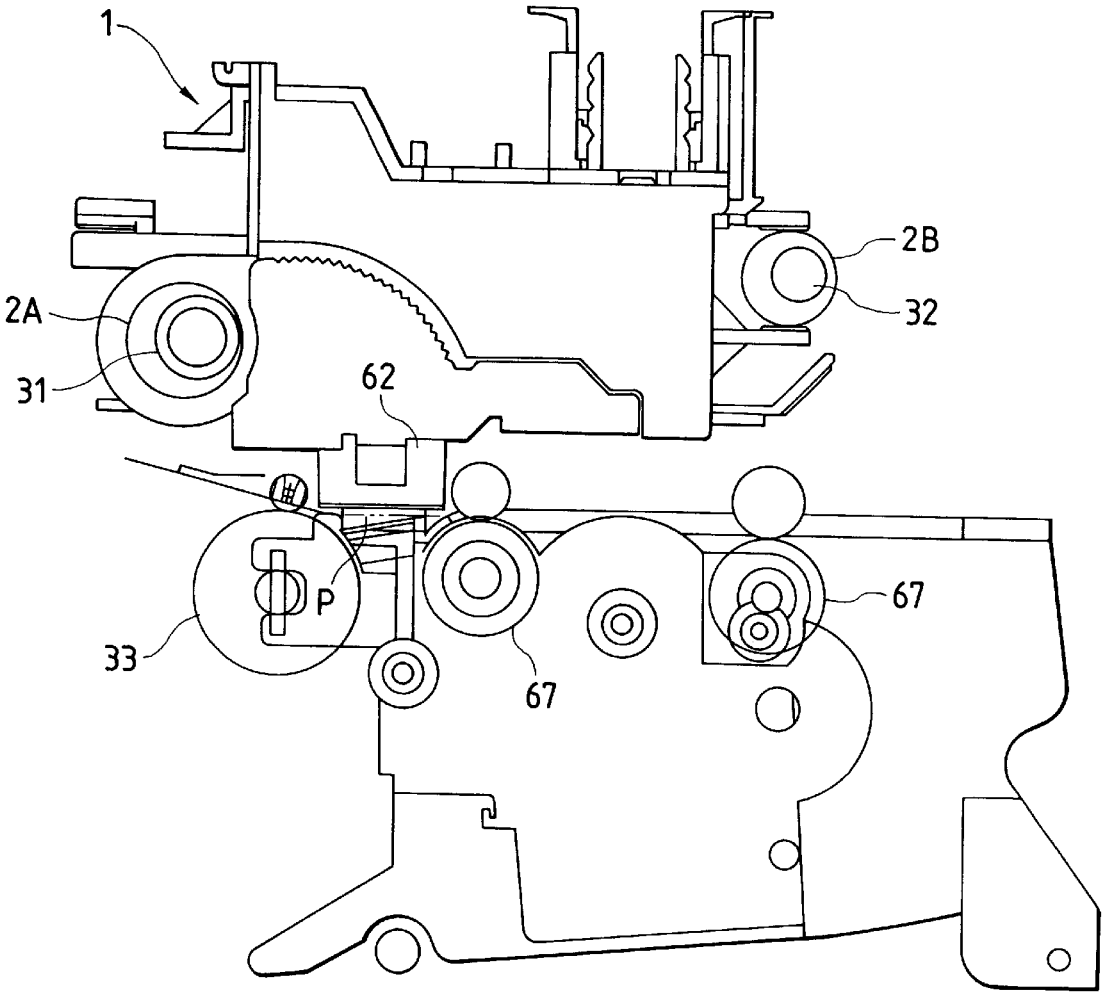
FIG. 11 is a diagram showing an example of a printer using the apparatus above.
Figure 12:
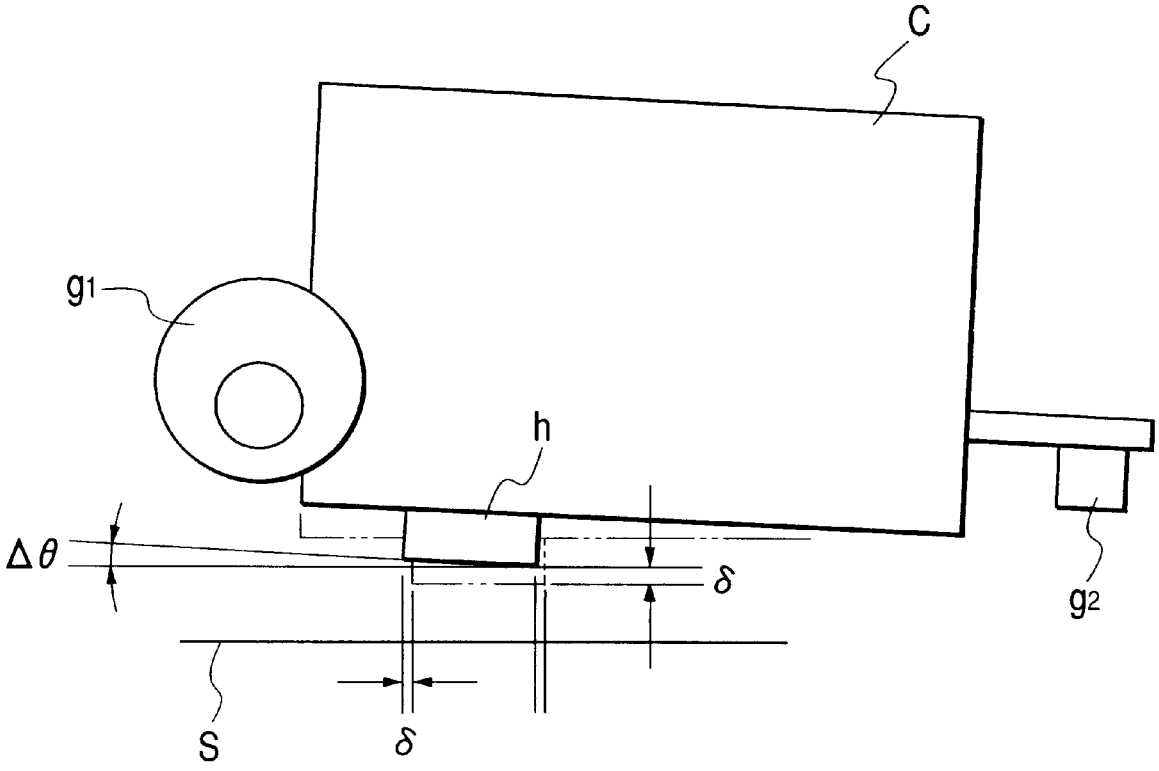
FIG. 12 is a diagram depicting problems concerning a conventional apparatus.

Referring to FIG. 11, there is given a description of a printer under an ink jet recording system using a platen-gap regulating apparatus according to the embodiemnt of the present invention.

In FIG. 11, a carriage 1 holds a recording head 62, and carries the same. Further, a pair of front and rear guide rods 2A, 2B for guiding the carriage 1 are rotatably mounted on a guide frame (not shown) via eccentric pins 31, 32 which are biased in the same direction and installed at both the respective ends of the carriage 1. When the guide rods 2A, 2B are operated by a carriage regulating unit 30, which will be described later, so that the guide rods are turned in the same direction, the carriage 1 which the guide rods 2A, 2B support is separated from or drawn near to a platen or a printing reference plane p in the absence of such a platen.

In this case, there are provided a paper feed roller 33, and paper discharge rollers 67.

FIGS. 5, 6, 9A, 9B, 10 show a gap regulating unit 30 according to an embodiment of the present invention, which gap regulating unit 30 is mounted on a side frame on one side of a printer body (not shown) via a unit frame 61. When the gap regulating unit 30 is operated by the carriage thus moved, it is driven by a paper feeding motor (not shown) to turn the two guide rods 2A, 2B by the same quantity.

A detailed description will subsequently be given of the gap regulating unit 30. A switch lever 35 which is displaced toward a position where it engages with an intermediate gear 39, which will also be described later, when it is pressed by the carriage 1 is supported pivotally, rotatably, and slidably in the axial direction at the end of a paper discharge roller shaft 34 driven by the paper feeding roller (not shown), the rotation of the paper discharge roller shaft 34 being integral with that of the paper discharge roller 67. The switch lever 35 is thus supported in such a state that it is urged by a spring 69 installed with respect to the unit frame 61 and always held in a non-engaging position.

A sun gear 36 is slidably fitted to the square shaft portion 8*a* of the paper discharge roller shaft 34 in the center of the switch lever 35. Further, two different-in-level planet gears 37, 38 which are kept in engagement with the sun gear 36 are supported on both sides of the switch lever 35, respectively. When the switch lever 35 is pressed by the carriage 1 and displaced, one of the planet gears 37, 38 is used to transmit gap regulating torque to the intermediate gear 39 according to the direction in which the paper feeding motor is rotated.

Figure 9A:
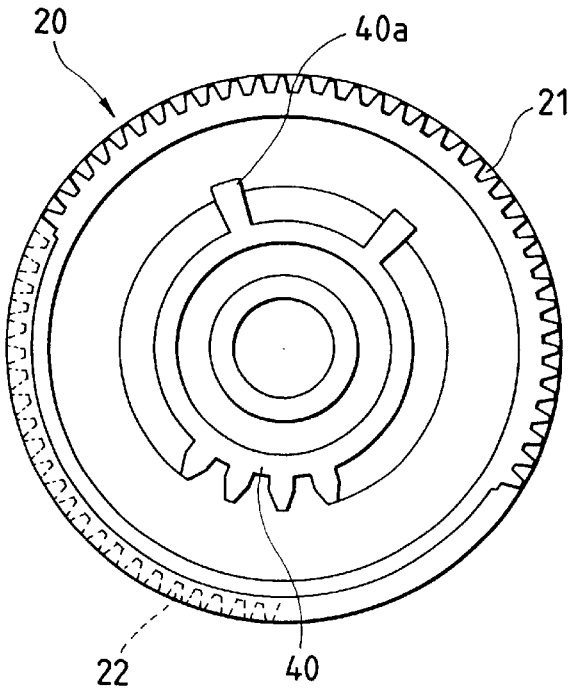
FIGS. 9A and 9B are a plan and a sectional view of an intermediate gear for use in the apparatus above.
Figure 9B:
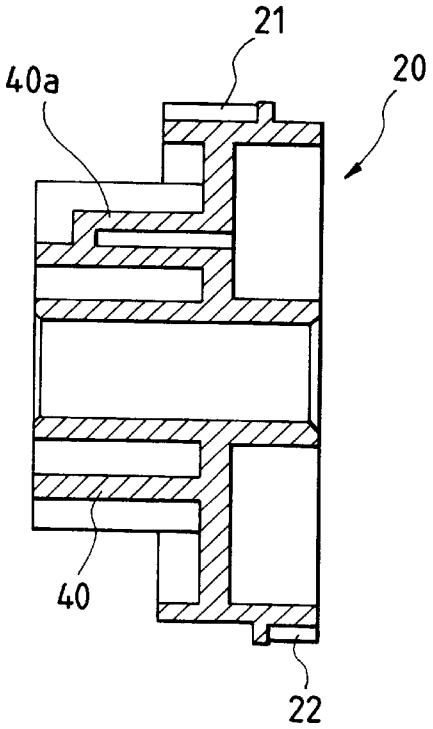

On the other hand, the intermediate gear 39 is, as shown in FIGS. 9A and 9B, formed with two different-in-level gear portions without teeth 21, 22 having a phase difference so that these gear portions selectively engage with the planet gears 37, 38, and a deformed Geneva gear portion 40 which engages with and disengages from a sector gear 41, which will be described later. The intermediate gear 39 is rotated by a predetermined quantity, irrespective of the rotational quantity of the planet gears 37, 38, so as to rotate the sector gear 41 by a predetermined angle.

On the contrary, the sector gear 41 is fixed to the end portion 32 of one guide rod 2B so that it is rotated integrally with the guide rod 2B. Further, a small fan-shaped gear 42 which is integral with the sector gear 41 engages with an airfoil sector gear 43 installed between both the guide rods 2A, 2B in order that unidirectional torque is transmitted via the gear 43 to a small fan-shaped gear 44 fixed to the end of the shaft 31 of the other guide rod 2A.

In this embodiment, a pawl 64 is formed on the back surface of the switch lever 35 and used to hold the switch lever 35 always in the non-engaging position by mating with an arcuate mating hole 68 bored in the unit frame 61.

With the arrangement above according to this embodiment of the present invention, the recording head 62 is made to hold a gap matching the thickness of ordinary paper by turning and positioning the two guide rods 2A, 2B so as to keep the eccentric pins 31, 32 substantially horizontally via the small fan-shaped gears 42, 44 engaging with the airfoil sector gear 43 as shown in FIGS. 5 and 11 in such a normal state that information is recorded/written onto the ordinary paper.

Figure 10:
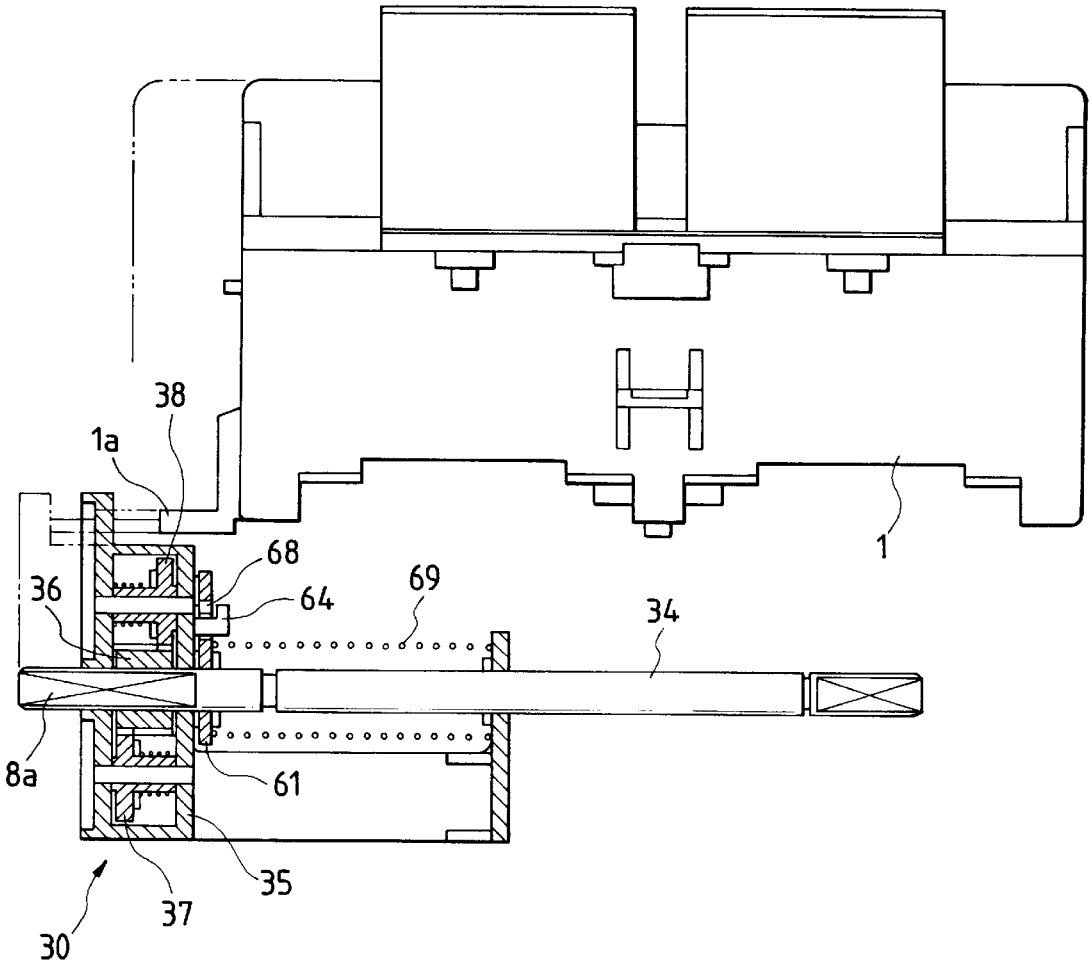
FIG. 10 is a diagram of the principal part of the apparatus above by reference to the movement of a carriage.

In that state, the pawl 64 projecting from the back surface of the switch lever 35 engages with the arcuate mating hole 68 of the unit frame 61 and holds the switch lever 35 in the position shown by a solid line of FIG. 10, that is, the non-engaging position.

In that state, further, an operating button on a panel (not shown) is depressed or an instruction as to permitting the platen gap to be altered is given from a personal computer in order to record/write information onto thick recording paper such as special paper for color printing, postcards and so on to move the carriage 1 to a platen-gap switching position at the beginning of the recording-writing operation, whereby the carriage 1 presses down part of the switch lever 35 with its projected end portion 1*a* with the effect of displacing the switch lever 35 toward the engaging position shown by a chain double-dashed line of FIG. 10.

On the other hand, the paper feeding motor (not shown) simultaneously rotates the paper discharge roller shaft 34 counterclockwise to turn the switch lever 35 counterclockwise via the planet gears 37, 38 engaging with the sun gear 16 at the end of the paper discharge roller shaft 34. Further, the one planet gear 37 is caused to engage with and rotate the intermediate gear 39 in the direction of an arrow in the drawing and then rotates the sector gear 41 by the predetermined quantity up to a position where the sector gear 41 engaging with the deformed Geneva gear portion 40 of the intermediate gear 39 is brought into contact with a stopper 40*a*. Further, the guide rod 2B integral with the sector gear 41 is turned clockwise in the drawing and the airfoil sector gear 43 is rotated in the direction of an arrow in the drawing via the small fan-shaped gear 42 integral with the sector gear 41. Further, the other guide rod 2A is turned in the same direction via the other small fan-shaped gear 44 engaging with the airfoil sector gear 43, and the carriage 1 is raised in parallel to the printing reference plane p by means of both the guide rods 2A, 2B.

When the platen-gap regulating apparatus is adapted for thin recording paper, it is needless to say that the platen gap is adjusted by reversely rotating the paper feeding motor.

Although a description has been given of a case where the carriage 1 is automatically displaced by the paper feeding motor in parallel to the printing reference plane p via the guide rods 3, 4 in the above-described embodiment of the present invention, two of the front and rear guide rods 3, 4 may be displaced manually in the same direction in order to displace the carriage 1 or the recording head 2 itself in parallel.

A head cleaning control method executed in the aforementioned ink jet recording apparatus will be described with reference to control flow as shown FIG. 7 and FIG. 8. In the following flow, the head cleaning operation will be described with reference to an example applied to control the platen-gap regulating means shown in FIG. 5 and FIG. 6, wherein the platen-gap PG is always held in a minimum state.

Figure 7:
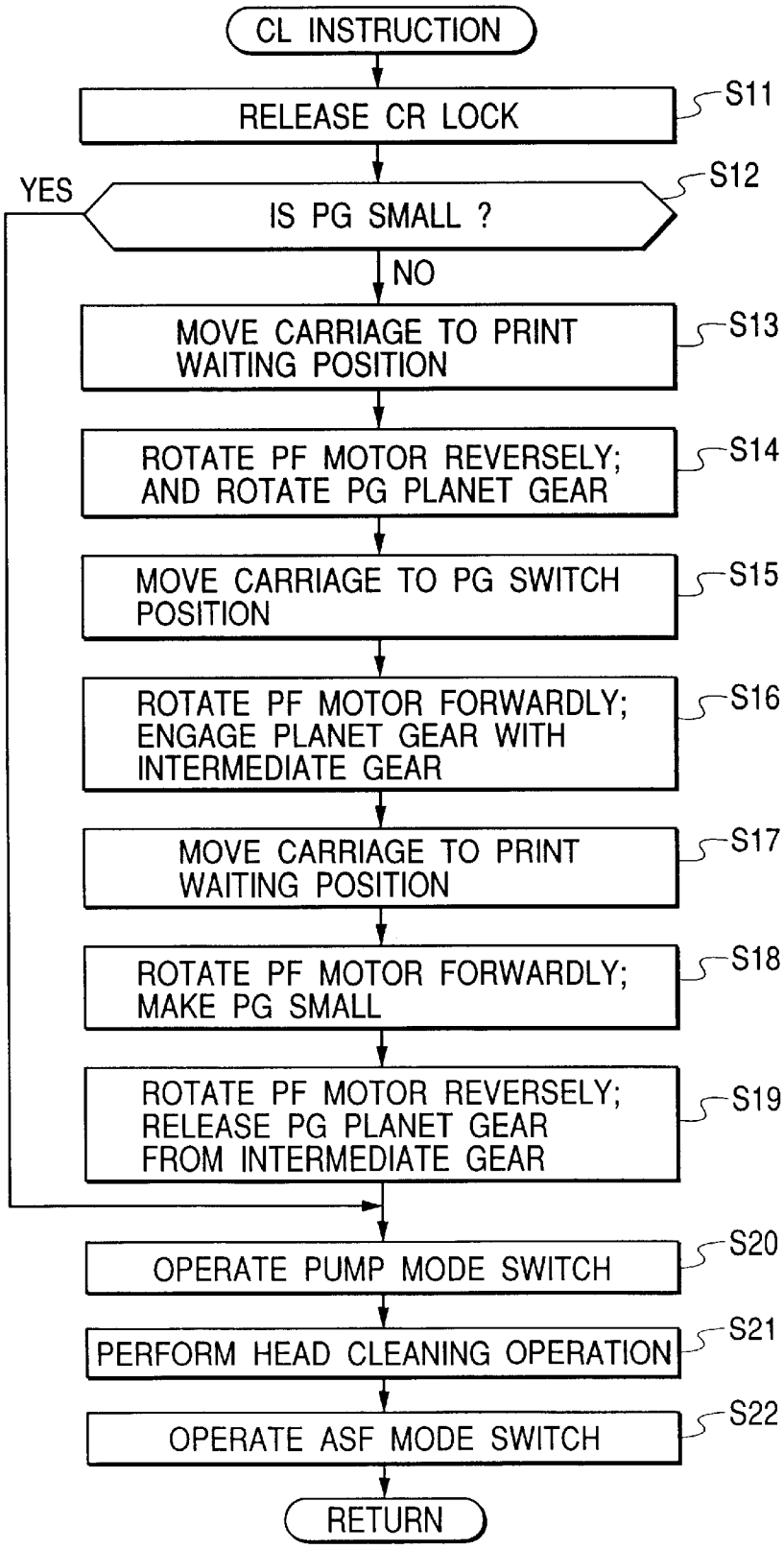
FIG. 7 is a flowchart showing a head cleaning control method according to the present invention.

In FIG. 7, when a cleaning control signal is output by operating a cleaning instruction switch, a carriage lock (hereafter called CR lock) is released in step S11.

In step S11, the heads 5 and 6 are sealed by the cap members 8 and 9 in a non-print mode. In order to maintain the situation, a CR lock mechanism (not shown) is contained for locking the carriage. The CR lock mechanism is mounted on a paper feed roller shaft and is released when the carriage is located in a home position (HP) to rotate a PF motor in the forward direction.

Next, step S12 judges as to whether or not the platen-gap PG is small. In this step S12, for example, the state of the platen-gap PG is known by means of a status parameter held by a host. When PG is judged as not to be small (No) in step S12, the carriage 1 is moved to a print waiting position in step S13. In step 14, the PF motor is rotated in the reverse direction to turn PG planet gears 37 and 38.

In step S15, the carriage CR is moved to a PG switch position. Thereby, a switch lever 35 is pressed along a shaft 34 by the carriage 1. In step S16, by rotating the PF motor in the forward direction, the planet gear 38 engages with an intermediate gear 39.

CR is moved to the print waiting position as shown in step 17, and the PF motor is rotated in the forward direction in step S18, so that PG is made small. Namely, in the platen-gap regulating means 30 shown in FIG. 5 by rotating each gear in the opposite direction of an arrow in FIG. 6, the carriage 1 is lowered in parallel against the printing reference plane, so that the platen-gap PG can be narrowed.

In step S19, rotating the PF motor in the reverse direction produces the opposite function of step S16 and cause the engagement of the planet gear 38 with the intermediate gear to release.

Further, the aforementioned step S13 through step S19 operate the platen-gap regulating means 30 shown in FIG. 5 and FIG. 6 and make the platen-gap PG small. When the platen-gap is judged small (Yes) in step S12, these processes are skipped and bypassed to the next step S20.

In step S20, the pump mode switch operation, or the power switch operation is performed. Although this is not shown in drawings, as described above, the ASF motor drive the pump unit 15 as well and switches the pump to a driving mode for applying a negative pressure against the heads during the head cleaning operation. After switching to the pump mode in step S20, the head cleaning operation is executed in step S21. After finishing such cleaning operation, in step 22 of FIG. 7, the ASF mode switch operation is executed, thus the sequence of the entire cleaning operation is completed.

Figure 8:
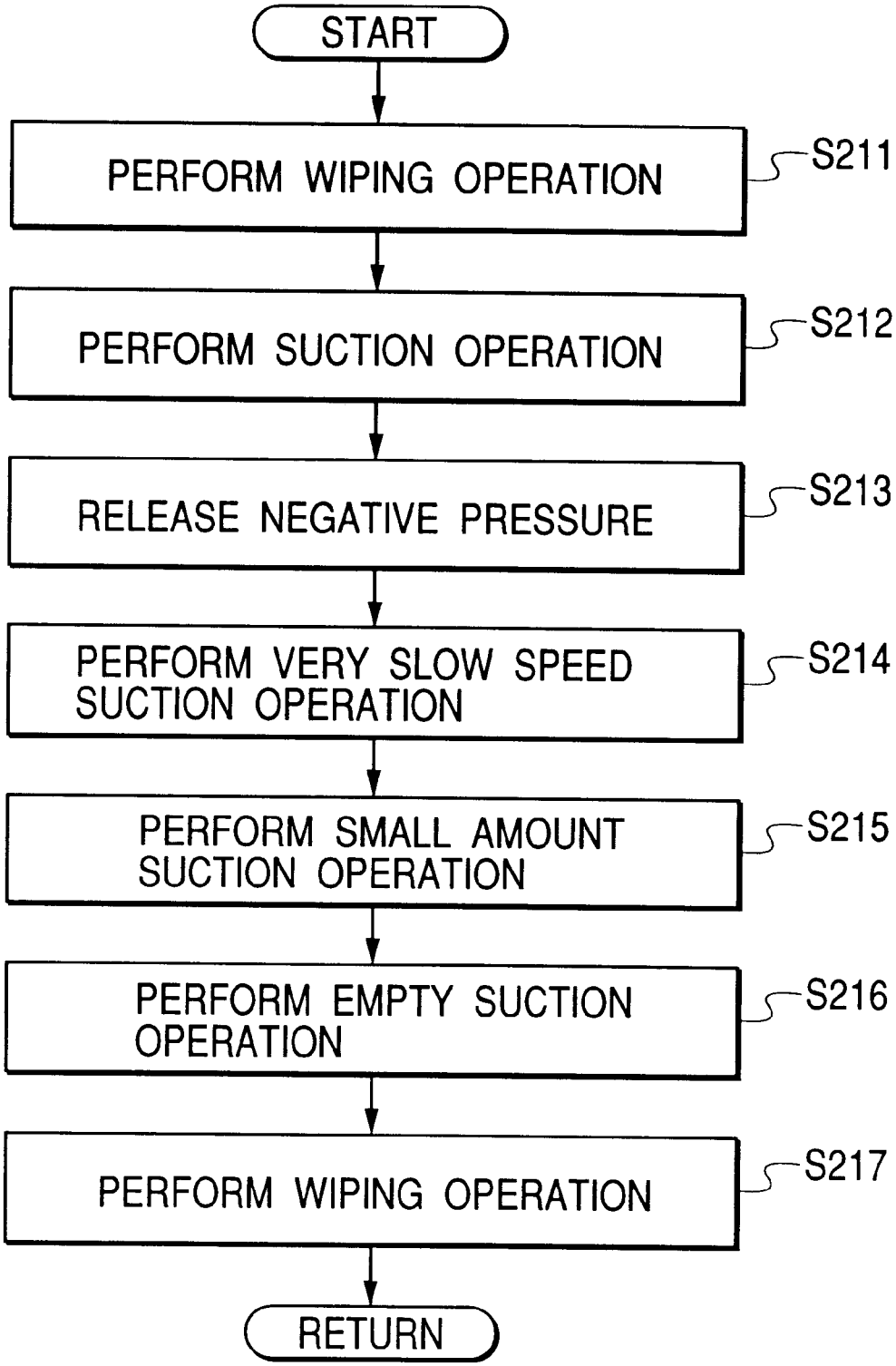
FIG. 8 is a flowchart showing detailed of cleaning operation step in the flowchart as shown in FIG. 7.

The outlined sequence of the cleaning operation is as shown in FIG. 8. Namely, in step S211, the recording heads 5 and 6 are moved to the side of the non-print section and cause to pass on the cleaning member comprises elastic plates such as rubber, disposed therein. Thereby, the wiping operation is performed for removing dust and paper dust adhered to the nozzle plate of the recording heads 5 and 6.

In this case, the platen-gap regulating means 30 is operated and controlled to make the platen gap PG small. Therefore, a contact extent against the nozzle plate of the recording heads 5 and 6 by the cleaning member 23, or the interference amount A is kept in the optimum state. This wiping operation in step S211 is performed to improve adhesiveness of the recording heads to the capping apparatus in the following process, wherein ink is forcibly sucked from the recording heads by the capping apparatus.

In the next step S212, the carriage 1 is moved to the capping position and starts the suction operation of great volume of ink from the recording heads 5 and 6. In other words, the recording heads 5 and 6 are sealed by the capping members 8 and 9 and the suction pump 15 is driven in a high speed by a predetermined time while air opening valves communicating to the capping members 8 and 9 are closed, thereby the capping members 8 and 9 accumulate strong negative pressures.

Consequently, relatively large volume of ink is discharged from the recording heads 5 and 6 to the capping members 8 and 9. After the suction pump stops, the negative pressure remains in the capping members 8 and 9 as well as the recording heads 5 and 6. Then, when the air opening valves are opened, air suddenly flows in the cap and may destroy meniscus of the heads. Therefore, the negative pressure is released by leaving as it is for a predetermined time (step S213).

In disposing suction at a very slow speed in the next step S214, ink in the cap is sucked without bubbling when the air opening valves are opened. Then, air inflows and small amount suction is executed by using the air as a dumper. By closing valves in step S215, small amount of ink suction for silently sucking ink inside of the heads is executed.

In disposing suction mode of step S216, the air opening valves are opened. The suction pump 15 is driven and ink stagnated inside of the capping members 8 and 9 is discharged to a disposal ink tank, which is not shown.

In the following step S217, the carriage 1 is moved toward the cleaning member 23. Accordingly, the capping members 8 and 9 descend and perform the wiping operation for sweeping ink adhered on the nozzle plate of the recording heads 5 and 6.

The aforementioned is described based on the embodiment, wherein the PF motor is also used as power to regulate the platen-gap. However, needless to say, the present invention can be applied not only to such a specific mechanism but also to other mechanisms.

Further, in the above-mentioned embodiment, with controlling the platen-gap PG to become the minimum state, the recording head cleaning operation by the capping members 8, 9 and the cleaning members 23 is to be performed. Of course, the same effect can be obtained by executing the head cleaning operation in an appropriate state besides keeping the platen-gap in the minimum state As set forth above, according to the present invention, since the pair of guide members for running the carriage mounted on the printer body are subjected to the same quantity of rotational adjustment of the sort described above via the eccentric portion, the carriage supported and guided by these guide members can always be regulated in parallel to the printing reference plane in proportion to the thickness of a recording medium, whereby print quality is held to be constant at all times, irrespective of the gap regulating operation.

Since the regulating means for regulating the carriage in the direction in which the carriage is separated from and drawn near to the printing reference plane according to the forward and reverse rotation of the paper-feed driving means is capable of engaging detachably with the guide members in such a way that the engagement of the regulating means therewith is interlocked with the movement of the carriage, the gap regulating operation is automatically performable only when the gap adjustment is made in accordance with a recording medium for printing.

As set forth above, according to the present invention with regard to the ink jet recording apparatus and its head cleaning control method, when the recording head cleaning instruction is received, the state of the platen-gap is judged. In case that the platen-gap is not fitted to the head cleaning operation, the platen-gap regulating means is driven by the control means.

Consequently, during the recording head cleaning operation, the ink suction operation by negative pressures can be ensured and the appropriate wiping operation is performed by the cleaning member. Therefore, the excellent cleaning operation for the recording heads can always be ensured. As a result, reliability of this type of ink jet recording apparatus can be improved.

What is claimed is:

1. An ink jet recording apparatus comprising:

ink jet recording heads for discharging ink droplets in accordance with print data;

a capping unit which seals said recording heads and for receiving a negative pressure from a suction pump;

a cleaning member for wiping a nozzle opening surface of said recording heads;

a platen-gap regulating means for adjusting a space between the recording heads and a printing medium in proportion to the thickness of the printing medium; and a control means for driving said platen-gap regulating means to hold a fixed relative position between the recording heads and said capping means and the recording heads and said cleaning member when said recording heads are located in a cleaning position.

2. An ink jet recording apparatus as claimed in claim 1, wherein said platen gap regulating means includes a pair of guide members rotatably mounted on the printer via an eccentric portion, said regulating means moves a carriage having the recording heads back-and-forth, and said control means provides rotating power to said guide members.

3. A head cleaning control method in the ink head recording apparatus which comprises ink jet recording heads for discharging ink droplets onto a printing medium in accordance with print data, a capping unit for sealing said recording heads and for receiving a negative pressure from a suction pump, and a cleaning member for wiping the nozzle opening surface of said recording heads, said head cleaning control method comprising the steps of:

judging a gap between said nozzle opening surface and said capping unit upon receiving a cleaning instruction for said recording heads;

controlling said gap to be a predetermined distance in proportion to the thickness of the printing medium; and cleaning said recording heads with one of said capping means and said cleaning member upon completing said gap control step.

4. The head cleaning control method in the ink jet recording apparatus as claimed in claim 3, wherein said gap judging step judges as to whether or not the paten-gap is in a minimum state, and when the platen-gap is judged not to be in the minimum state, the platen-gap is controlled to become the minimum state in said gap control step.

5. A platen-gap regulating apparatus for regulating a carriage with respect to a platen of a printer, the platen-gap regulating apparatus comprising;

a pair of guide members rotatably mounted on the printer via an eccentric portion, wherein the guide members guide the carriage, and regulating means for imparting a same rotational displacement quantity to the guide members, wherein the carriage is separated from and drawn near to a printing reference plane in parallel thereto.

6. The platen-gap regulating apparatus as claimed in claim 5, wherein the regulating means regulates both the guide members forwardly and reversely by the same quantity in the same direction in response to the forward and reverse rolling of a paper-feed driver, and the regulating means engages with or detaches form both the guide members in response to moving of the carriage.

7. A platen-gap regulating apparatus in a printer in which a carriage is moved along a pair of guide rods, the platen-gap regulating apparatus comprising:

eccentric pins, each eccentrically supporting a respective one of said guide rods; and a linking portion linking the eccentric pins, for moving the eccentric pins such that the guide members are moved in parallel by the eccentric pins; wherein the linking portion comprises:

small fan-shaped gears, each fixed to a respective eccentric pin; and an airfoil sector gear having sector gear portions engaging with the small fan-shaped gears of the eccentric pins.

8. The platen-gap regulating apparatus according to claim 7 further comprising:

a sector gear pivotable with one of the eccentric pins;

an intermediate gear engaging with the sector gear; and a switch lever selectively driving the intermediate gear.

9. A platen gap regulator comprising:

a carriage on which a recording head is mounted;

a pair of guide rods for supporting both side end portions of the carriage, along which the carriage reciprocally moves;

a first eccentric pin provided with one of the guide rods and rotated by a predetermined angle so as to move one side end portion of the carriage in a direction perpendicularly to a plane defined by the pair of guide rods;

a second eccentric pin provided with the other one of the guide rods and subsequently rotated by the predetermined angle when the first eccentric pin is rotated, so as to move the other side end portion in the same direction as the direction in which the one end portion of the carriage is moved; and a linking portion linking the first and second eccentric pins, for moving the eccentric pins such that the guide members are moved in parallel by the eccentric pins; wherein the linking portion comprises:

fan-shaped gears, each fixed to a respective eccentric pin; and an airfoil sector gear having sector gear portions engaging with the fan-shaped gears of the eccentric pins.

10. The platen gap regulator as claimed in claim 9, wherein the first and second eccentric pins are adapted to rotate by the predetermined angle to permit the carriage to compensate for varying thicknesses of recording medium on which information is recorded by the recording head.

11. The platen gap regulator as claimed in claim 9, further comprising a gear mechanism for transmitting the rotation force of the first eccentric pin to the second eccentric pin.

12. The platen gap regulator as claimed in claim 11, wherein the rotation of the first eccentric pin is effected by a drive mechanism for feeding a recording medium on which information is recorded by the recording head.

13. A platen gap regulator comprising:

a carriage on which a recording head is mounted;

a pair of guide rods for supporting both side end portions of the carriage, along which the carriage reciprocally moves;

a first eccentric pin provided with one of the guide rods and rotated by a predetermined angle so as to move one side end portion of the carriage in a direction perpendicularly to a plane defined by the pair of guide rods;

a second eccentric pin provided with the other one of the guide rods and subsequently rotated by the predetermined angle when the first eccentric pin is rotated, so as to move the other side end portion in the same direction as the direction in which the one end portion of the carriage is moved; and a gear mechanism for transmitting the rotation force of the first eccentric pin to the second eccentric pin, wherein the rotation of the first eccentric pin is effected by a drive mechanism for feeding a recording medium on which information is recorded by the recording head.

14. The platen gap regulator as claimed in claim 13, wherein the first and second eccentric pins are adapted to rotate by the predetermined angle to permit the carriage to compensate for varying thicknesses of recording medium on which information is recorded by the recording head.

* * * * *